United States Patent [19]

Yasuhara et al.

[11] 4,294,220

[45] Oct. 13, 1981

[54] INTAKE PORT MEANS FOR EXTRACTING ENGINE EXHAUST GAS FOR RECIRCULATION

[75] Inventors: Seishi Yasuhara, Yokosuka; Eiichi Ohnishi, Tokyo, both of Japan

[73] Assignee: Nissan Motor Co., Ltd., Yokohama, Japan

[21] Appl. No.: 111,555

[22] Filed: Jan. 14, 1980

[30] Foreign Application Priority Data

Jan. 17, 1979 [JP] Japan ..... 54/4411[U]

[51] Int. Cl.[3] ..... F02M 25/06

[52] U.S. Cl. ..... 123/568; 60/278

[58] Field of Search ..... 123/568, 569, 570, 571; 60/278, 279

[56] References Cited

U.S. PATENT DOCUMENTS

| | | | |
|---|---|---|---|
| 1,675,611 | 7/1928 | Lacy | 123/568 |
| 2,870,758 | 1/1959 | Standiford | 123/568 |
| 3,186,392 | 6/1965 | Gregoric | 123/568 |

FOREIGN PATENT DOCUMENTS 2136284 12/1972 France .

*Primary Examiner*—Wendell E. Burns

*Attorney, Agent, or Firm*—James C. Wray

[57] ABSTRACT

An intake port means for extracting engine exhaust gas for recirculation having an extracting aperture placed in a stream of the engine exhaust gas and a cover having its closed end lying on the upstream side of said aperture while having its open end facing the downstream side from said aperture, so that the engine exhaust gas is extracted through trailing portion of the open end of the cover.

10 Claims, 6 Drawing Figures

INTAKE PORT MEANS FOR EXTRACTING ENGINE EXHAUST GAS FOR RECIRCULATION

BACKGROUND OF THE INVENTION

1. Field of the Invention

This invention relates to an intake port means for extracting engine exhaust gas for recirculation in a Diesel engine using exhaust gas recirculation (EGR) system.

2. Description of the Prior Art

Exhaust gas from a Diesel engine contains a large amount of soot and other minute particles, and if such soot and minute particles are recirculated together with the recirculation gas in the EGR system, various disturbances are caused by deterioration of oil or deposit of the soot. Thus, there is a need for a structure which minimizes the entry of such soot and minute particles into the EGR system at an intake port for extracting the exhaust gas. At present, Diesel engines equipped with such an EGR system in the market are relatively few, but the current trend is to apply the EGR system to Diesel engines for the purpose of purification of the exhaust gas.

In the case of gasoline engines, which are now available in the market, negative pressure at the intake side of an intake port for extracting the engine exhaust gas for EGR is large, and the EGR is effected by using such intake negative pressure, so that contrivances are made in workability and durability of the EGR system while facilitating the EGR itself, but there has not been any significant consideration from other viewpoints. Accordingly, the physical configuration of the extracting inlet for EGR is simply a hole bored on a tube wall. If the same aperture for extracting the exhaust gas for EGR as that of the conventional gasoline engine is applied to a Diesel engine, since the maximum flow rate of EGR required for the Diesel engine is large and can be comparable with the intake flow rate thereof, minute particles in the exhaust gas such as soots of the Diesel engine are apt to be recirculated back to the engine together with the exhaust gas for EGR.

In the case of a Diesel engine, the intake pressure is low, and as compared with a gasoline engine, several times more of EGR is necessary for achieving the same degree of nitrogen oxide (NOx) reduction, and hence, the extracting inlet port of the exhaust gas must be fairly large. Besides, combustion products contained in the exhaust gas, such as soots and minute particles, may cause various disturbances, e.g., deposits in the EGR system resulting in a deterioration of the function thereof, entering in engine cylinders to cause an accelerated abrasion of cylinder walls and piston rings, and an accelerated deterioration of lubricating oil.

SUMMARY OF THE INVENTION

An object of the present invention is to obviate the aforementioned difficulties of the prior art techniques, by providing a novel intake port means for extracting exhaust gas for recirculation which prevents minute particles from entering into the EGR system. In other words, an object of the present invention is to provide a contrivance which makes it difficult for minute particles to enter into an aperture for extracting exhaust gas.

An intake port means for extracting engine exhaust gas for recirculation, according to the present invention, includes an extracting aperture placed in a stream of the engine exhaust gas, e.g., in an exhaust gas piping, and a cover with a closed end and an open end. The closed end of the cover is on the upstream side of the aforesaid aperture, and the open end of the cover faces the downstream side of the aforesaid aperture, whereby, the engine exhaust gas is extracted through trailing portion of the open end of the cap. With the cover disposed in the aforesaid manner, the engine exhaust gas is once forced to bypass the extracting aperture and then allowed to turn backward, with respect to the general line of flow of the exhaust gas, before being extracted for recirculation. Due to the inertia, minute particles in the engine exhaust gas can hardly turn backward, so that it becomes possible to extract solely the exhaust gas while preventing minute particles being extracted. The aperture means according to the present invention may be located at the manifold of an engine or at just downstream of such exhaust manifold, a catalyzer, a premaffler, or a main muffler of the engine.

BRIEF DESCRIPTION OF THE DRAWING

For a better understanding of the present invention, reference is made to the accompanying drawing, in which.

DESCRIPTION OF THE PREFERRED EMBODIMENTS

Figure 1A:
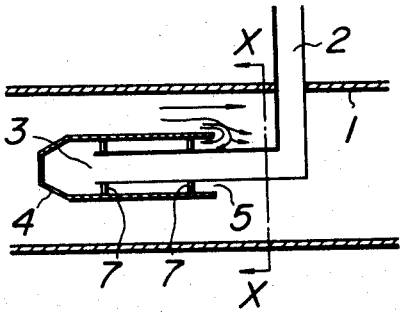
FIG. 1A is a longitudinal cross-sectional view in a schematic form of the essential portion of an embodiment of the present invention.
Figure 1B:
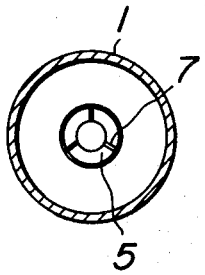
FIG. 1B is a lateral cross-sectional view taken along the line X—X of FIG. 1A.
Figure 2:
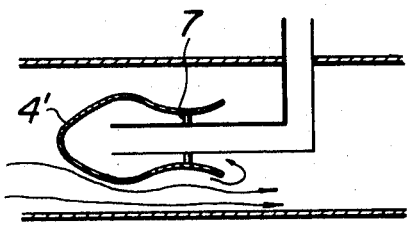
FIGS. 2 through 4 are longitudinal cross-sectional views of essential portions of other embodiments of the present invention, respectively.
Figure 3:
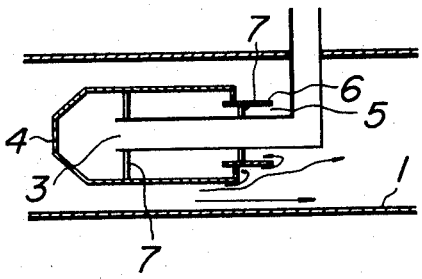
Figure 4:
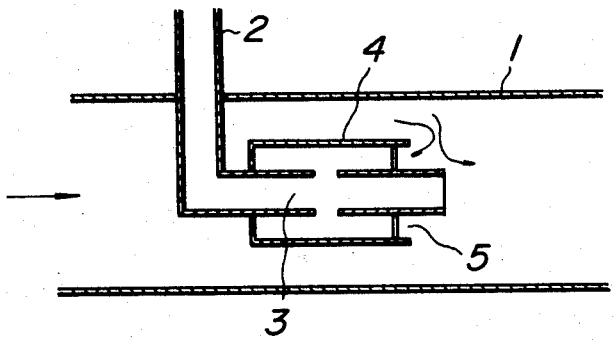
Figure 5:
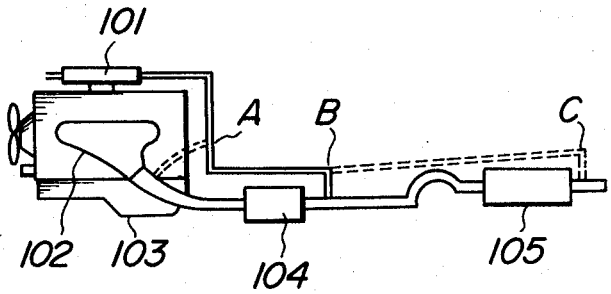
FIG. 5 is a schematic diagram illustrating different possible positions for locating the extracting aperture means of the present invention.

An intake port means for extracting engine exhaust gas for recirculation to an intake system can be located at different positions; namely, at or immediately downstream of an exhaust manifold of an engine, with respect to the flowing direction of engine exhaust gas, as shown by the point A of FIG. 5; downstream of a premuffler or a catalyzer, as shown by the point B of FIG. 5; or at a tail pipe downstream of a main muffler, as shown by the point C of FIG. 5. The intake port means according to the present invention can also be located at any of the aforesaid three points A, B and C. FIG. 5 shows the case of the engine exhaust gas recirculating path including the extraction at the point B as an example illustrated by solid lines, while the paths relating to the extraction at the points A and C are illustrated as the possible alternatives by dotted lines. In this figure, an intake manifold 101 is for supplying fuel-air mixture to an engine 103 with an exhaust manifold 102, and the exhaust gas from the engine is directed toward a premuffler or a catalyzer 104 and further toward a main muffler 105.

Preferred embodiments of the present invention will now be described in detail by referring to FIGS. 1 through 4 which show the piping just schematically. As shown in the figures, an exhaust gas pipe 1 communicates with an EGR pipe 2 through an extracting inlet or aperture 3 for functioning as an intake opening or intake port for recirculating the exhaust gas. In the illustrated embodiments, the extracting aperture 3 is located in the middle of the stream of the exhaust gas. A cap 4 is disposed in such a manner that the closed end of the cap 4 is on the upstream side of the extracting aperture 3 with a spacing therefrom while the open end 5 of the cap 4 faces the downstream side of the extracting aperture 3. The cap thus disposed is for utilizing a phenomenon that minute particles with certain mass have a larger inertia than that of the exhaust gas and the moving direction of the minute particles are difficult to change. More particularly, the minute particles in the exhaust gas are accelerated at the outer peripheral wall of the cap 4 by the Venturi tube effect, and if thus accelerated minute particles are to enter the extracting aperture 3, they are required to make a 180° turn before such entry. By this arrangement, it is made difficult for the minute particles to enter the aperture 3. The embodiments of FIGS. 1 through 3 have the extracting apertures 3 directed toward the upstream, so as to require more turning of the exhaust gas before entering into the EGR pipe 2, as compared with the embodiment of FIG. 4 having the extracting aperture 3 directed toward the downstream of the exhaust gas in the pipe 1. With the embodiment of FIG. 2, the shape of the cap 4' is such that the minute particles are accelrated in outward directions (centrifugal directions), so as to effect further separation of the minute particles from the exhaust gas, as compared with the embodiment of FIG. 1. The embodiment of FIG. 3 includes streamlining plates 6 disposed adjacent the open end 5 of the cover 4, for the purpose of streamlining the flow of the exhaust gas there and preventing excessive tubulence there. In the embodiments of FIGS. 1 through 4 the reference numeral 7 represents support rods.

With the construction described above, the exhaust gas is extracted through the open end 5 of the cover 4 located downstream only after the acceleration caused by the presence of the cap 4, so that the effect of removing the minute particles can be achieved. Besides, when the soot particles in the exhaust gas cohere with each other, the larger the cohered particles are, the greater the mass of each particle will become and the turning of such particles will become more difficult. Accordingly, with the aforesaid construction requiring the recirculation gas to make a 180° turn downstream the cap 4, it becomes difficult for the soot particles to enter into the recirculating exhaust gas of EGR system and the absolute amount of the soot in the recirculating exhaust gas is reduced. Furthermore, the cap 4 acts to reduce the effective inside cross section of the exhaust gas pipe 1, so that the velocity of the exhaust gas is increased for enhancing the separation of the minute particles. If the extracting aperture is located far away from the engine, for instance, at a position downstream the muffler, the cohesion of the soot particles is further enhanced by the increased chance of collision between each other and the increased condensation of the moisture in the exhaust gas, whereby the separation of the minute particles is still more intensified. When catalyzers or smoke traps are disposed in the passage of the exhaust gas, a considerable reduction of the amount of minute particles can be expected thereby, so that it is more desirable to extract the exhaust gas for EGR after passage through such catalyzers or smoke traps.

The present invention fulfills the following effects by reducing the amount of minute particles in the exhaust gas of the EGR system, namely:

(i) The amount of deposit in the gas passages of the EGR system is reduced, and the ability of maintaining the function of the EGR system can be improved.

(ii) The abrasion of the piston, piston ring, and cylinder of the engine by the minute particles can be reduced.

(iii) The amount of the minute particles mixed in the lubricating oil is reduced, so that the deterioration of the lubricating oil by the EGR system is minimized.

(iv) Due to the reduction of the deterioration of the lubricating oil, abrasion of those engine parts which are lubricated by such lubricating oil is reduced.

Thus, the present invention contributes greatly to the maintenance of the engine and the reduction of the engine running cost.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. An intake port means for extracting engine exhaust gas for recirculation in an internal combustion engine having an exhaust gas recirculation (EGR) system, comprising an intake port means formed of an EGR pipe and having an extracting aperture placed in a stream of the engine exhaust gas, and a cover having a closed end lying on the upstream side of said aperture while having an open end facing the downstream side of said aperture in such a manner that the engine exhaust gas is extracted through trailing portion of the open end of the cover.

2. An intake port means as set forth in claim 1, wherein said extracting aperture opens toward upstream of said stream of the engine exhaust gas.

3. An intake port means as set forth in claim 1, wherein said extracting aperture opens toward downstream of said stream of the engine exhaust gas.

4. An intake port means as set forth in claim 1, wherein said cover has a substantially cylindrical shape with one end closed and the opposite end open.

5. An intake port means as set forth in claim 1, wherein said closed end of said cover has a substantially cone shape with a pointed end facing upstream of said stream of the engine exhaust gas.

6. An intake port means as set forth in claim 1, wherein said extracting aperture is at an exhaust manifold of said internal combustion engine.

7. An intake port means as set forth in claim 1, wherein said extracting aperture is at just downstream of an exhaust manifold of said internal combustion engine, with respect to said stream of the engine exhaust gas.

8. An intake port means as set forth in claim 1, wherein said extracting aperture is at just downstream of a premuffler of said internal combustion engine, with respect to said stream of the engine exhaust gas.

9. An intake port means as set forth in claim 1, wherein said extracting aperture is at just downstream of a catalyzer means of said internal combustion engine, with respect to said stream of the engine exhaust gas.

10. An intake port means as set forth in claim 1, wherein said extracting aperture is at just downstream of a main muffler of said internal combustion engine, with respect to said stream of the engine exhaust gas.

* * * * *